US010937373B2

(12) United States Patent
Baek

(10) Patent No.: US 10,937,373 B2
(45) Date of Patent: Mar. 2, 2021

(54) DISPLAY DEVICE FOR EXTERNAL COMPENSATION AND METHOD OF DRIVING THE SAME

(71) Applicant: LG Display Co., Ltd., Seoul (KR)

(72) Inventor: Lok-Dam Baek, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/696,747

(22) Filed: Nov. 26, 2019

(65) Prior Publication Data

US 2020/0175928 A1 Jun. 4, 2020

(30) Foreign Application Priority Data

Nov. 29, 2018 (KR) ..... 10-2018-0150914

(51) Int. Cl.
*G09G 3/3291* (2016.01)

(52) U.S. Cl.
CPC ... *G09G 3/3291* (2013.01); *G09G 2310/0286* (2013.01); *G09G 2310/0289* (2013.01); *G09G 2310/08* (2013.01)

(58) Field of Classification Search
CPC ..... G09G 3/3291; G09G 2310/08; G09G 2310/0289; G09G 2310/0286; G09G 2320/045; G09G 2320/029; G09G 2320/0285; G09G 2300/0413; G09G 3/3208
See application file for complete search history.

(56) References Cited

U.S. PATENT DOCUMENTS 6,873,312 B2 * 3/2005 Matsueda ..... G09G 3/2011 345/90
2004/0021496 A1 * 2/2004 Shin ..... H03K 19/01714 327/333
2005/0001805 A1 * 1/2005 Jeon ..... G11C 19/28 345/92
2007/0296682 A1 * 12/2007 Hwang ..... G11C 19/00 345/100
2008/0001887 A1 * 1/2008 Hong ..... G09G 3/3677 345/94
2008/0136756 A1 * 6/2008 Yeo ..... G09G 3/3677 345/87
2008/0136809 A1 * 6/2008 Lee ..... G09G 3/3677 345/214
2008/0165110 A1 * 7/2008 Kim ..... G11C 19/28 345/99
2008/0211760 A1 * 9/2008 Baek ..... G11C 19/184 345/98
2009/0002264 A1 * 1/2009 Pai ..... G09G 3/3666 345/3.2

(Continued)

*Primary Examiner* — Amy Onyekaba
(74) *Attorney, Agent, or Firm* — Birch, Stewart, Kolasch & Birch, LLP

(57) ABSTRACT

A display device for external compensation and a method of driving the same, are discussed. The display device includes a plurality of display lines of a display panel which are divided into two areas to perform driving to output black data through a second display line area while an image is displayed through a first display line area, such that two display lines are sensed in one non-emission period (blank). Two level shifters alternately perform real-time sensing and recovery operation in one non-emission period and two display lines can be compensated in one frame.

12 Claims, 15 Drawing Sheets

(56) References Cited

U.S. PATENT DOCUMENTS

| | | | | |
|---|---|---|---|---|
| 2014/0104248 | A1* | 4/2014 | Won | G09G 5/00 345/204 |
| 2015/0187267 | A1* | 7/2015 | Park | G09G 3/3233 345/77 |
| 2015/0187268 | A1* | 7/2015 | Tani | G09G 3/3233 345/77 |
| 2015/0206502 | A1* | 7/2015 | Hwang | G09G 3/3618 345/213 |
| 2015/0364078 | A1* | 12/2015 | Shim | G09G 3/2092 345/211 |
| 2017/0123582 | A1* | 5/2017 | Kim | G09G 3/2092 |
| 2017/0249904 | A1* | 8/2017 | Li | G09G 3/3233 |
| 2017/0270864 | A1* | 9/2017 | So | G09G 3/3233 |
| 2018/0053462 | A1* | 2/2018 | Bae | G09G 3/2074 |
| 2018/0075808 | A1* | 3/2018 | Yamashita | G09G 3/3266 |
| 2018/0130423 | A1* | 5/2018 | Kim | H01L 27/3262 |
| 2018/0137825 | A1* | 5/2018 | An | G09G 3/3266 |
| 2018/0151124 | A1* | 5/2018 | An | G09G 3/3291 |
| 2019/0156783 | A1* | 5/2019 | Kim | G09G 5/14 |

* cited by examiner

DISPLAY DEVICE FOR EXTERNAL COMPENSATION AND METHOD OF DRIVING THE SAME

CROSS-REFERENCE TO RELATED APPLICATIONS

This application claims the priority benefit of Korean Patent Application No. 10-2018-0150914, filed on Nov. 29, 2018 in the Republic of Korea, which is hereby incorporated by reference as if fully set forth herein.

BACKGROUND OF THE INVENTION

Field of the Invention

The present invention relates to a display device for external compensation and a method of driving the same.

Discussion of the Related Art

Various flat panel display devices have been developed and sold. Among such display devices, an electroluminescent display device is divided into an inorganic light emitting display device and an organic light emitting display device according to the material of a light emitting layer. An active matrix type organic light emitting display device includes an organic light emitting diode (OLED) for emitting light by itself and thus has a high response speed, high luminous efficiency, high luminance and a wide viewing angle.

The OLED, which is a self-luminous element, includes an anode, a cathode and an organic compound layer formed therebetween. The organic compound layer includes a hole injection layer (HIL), a hole transport layer (HTL), an emissive layer (EML), an electron transport layer (ETL) and an electron injection layer (EIL). When a power supply voltage is applied to the anode and the cathode, holes passing through the hole transport layer (HTL) and electrons passing through the electron transport layer (ETL) are moved to the emissive layer (EML) to form excitons and, as a result, the emissive layer (EML) generates visible light.

The organic light emitting display device includes pixels each including an OLED and a driving thin film transistor (TFT) where the pixels are arranged in a matrix. The organic light emitting display device controls luminance of an image implemented in the pixels according to gray scales of image data. The driving TFT controls driving current flowing in the OLED according to a voltage (hereinafter referred to as a gate-source voltage) between gate and source electrodes thereof. The amount of light emitted by the OLED is determined according to the driving current and luminance of an image is determined by the amount of light emitted by the OLED.

In general, when the driving TFT operates in a saturation region, pixel current Ids flowing between the drain and source of the driving TFT is expressed as shown in Equation 1 below.

$$I_{ds} = \frac{\left(\mu \times C \times \frac{W}{L}\right) \times (V_{gs} - V_{th})^2}{2} \quad \text{Equation 1}$$

In Equation 1, μ denotes electron mobility, C denotes the capacitance of a gate insulating film, W denotes the channel width of the driving TFT, and L denotes the channel length of the driving TFT. In addition, Vgs denotes the gate-source voltage of the driving TFT and Vth denotes the threshold voltage of the driving TFT. According to the pixel structure, the gate-source voltage Vgs of the driving TFT can be a voltage difference between a data voltage and a reference voltage. Since the data voltage is an analog voltage corresponding to the gray scale of image data and the reference voltage is a fixed voltage, the gate-source voltage Vgs of the driving TFT is programmed (or set) according to the data voltage. In addition, the driving current Ids is determined according to the programmed gate-source voltage Vgs.

The electrical characteristics of the pixel such as the threshold voltage Vth of the driving TFT, the electron mobility μ of the driving TFT and the threshold voltage of the OLED are factors determining the driving current Ids and thus should be the same in all pixels. However, the electrical characteristics can differ between the pixels by various causes such as process characteristics and time-varying characteristics. Such an electrical characteristic deviation causes luminance deviation and thus may not realize a desired image.

In order to compensate for a luminance deviation between pixels, external compensation technology for sensing the electrical characteristics of the pixels and correcting digital data of an input image based on the result of sensing is known. In order to compensate for the luminance deviation, when a data voltage applied to the pixel is changed by Δx, current change of Δy needs to be secured. Accordingly, the external compensation technology implements the same brightness by calculating Δx of each pixel and applying the same pixel current to OLEDs. That is, the external compensation technology performs compensation to equalize the brightness of the pixels, by controlling gray scale values.

The electrical characteristics of the pixels continuously vary during driving. Accordingly, in order to increase external compensation performance, real-time (RT) compensation technology for compensating for change in electrical characteristics of pixels in real time is required.

In order to implement the RT compensation technology, a method of performing sensing driving in a vertical blank period in which input image data is not written has been proposed. The vertical blank period is disposed between vertical active periods, in which input image data is written, in one frame. A general driving circuit for external compensation senses predetermined display lines in one frame using the vertical blank period. To this end, a gate driver included in the conventional driving circuit for external compensation generates a sensing gate signal during the vertical blank period and applies the sensing gate signal to pixels formed at display lines to be sensed. The gate driver includes a plurality of stages connected in cascade.

The vertical blank period is much shorter than the vertical active period. Since each of the stages configuring the gate driver receives an output signal of a previous stage as a carry signal to sequentially operate, the limited vertical blank period can be insufficient to generate a desired sensing gate signal. For example, in order to sense an N-th display line of a display panel having vertical resolution of N, an N-th sensing gate signal generated in an N-th stage is necessary. However, since the N-th stage operates after first to (N−1)-th stages sequentially operate, all stages of the gate driver should operate in order to generate the N-th sensing gate signal. One vertical blank period is insufficient to operate all stages of the gate driver. Such a problem becomes serious as the vertical resolution of the display panel increases and as the number of display lines to be sensed within one vertical blank period increases.

SUMMARY OF THE INVENTION

Accordingly, the present invention is directed to a display device for external compensation and a method of driving the same that substantially obviate one or more problems due to limitations and disadvantages of the related art.

An object of the present invention is to provide a display device for external compensation capable of shortening a real-time compensation time, and a method of driving the same.

Another object of the present invention is to provide a display device for external compensation capable of compensating for two display lines in real time during one frame, and a method of driving the same.

Another object of the present invention is to provide a display device for external compensation capable of efficiently utilizing two level shifters in the display device using two level shifters, and a method of driving the same.

Additional advantages, objects, and features of the invention will be set forth in part in the description which follows and in part will become apparent to those having ordinary skill in the art upon examination of the following or can be learned from practice of the invention. The objectives and other advantages of the invention can be realized and attained by the structure particularly pointed out in the written description and claims hereof as well as the appended drawings.

To achieve these objects and other advantages and in accordance with the purpose of the invention, as embodied and broadly described herein, a display device for external compensation includes a display panel provided with a plurality of display lines each including a plurality of pixels, a timing controller configured to divide the plurality of display lines into two areas, to output black data through a second display line area (B) while an image is displayed through a first display line area (A), and to output a signal for performing control to sense two display lines in a non-emission period of one frame, a first level shifter LS1 configured to receive a control signal from the timing controller and to output a signal for performing real-time (RT) sensing and recovery operation of the first display line area (A) of the plurality of display lines in one non-emission period, and a second level shifter LS2 configured to receive a control signal from the timing controller and to output a signal for performing real-time (RT) sensing and recovery operation of the second display line area (B) of the plurality of display lines in one non-emission period.

The first level shifter and the second level shifter can alternately perform RT sensing and recovery operation during one non-emission period.

The second level shifter can output black data while the first level shifter performs RT sensing operation and recovery operation, and the first level shifter can output black data while the second level shifter performs RT sensing operation and recovery operation.

Operation of outputting black data by the second level shifter when the first level shifter performs RT sensing operation, operation of performing RT sensing operation by the second level shifter while the first level shifter outputs black data, operation of outputting black data by the second level shifter when the first level shifter performs recovery operation, and operation of performing recovery operation by the second level shifter while the first level shifter outputs black data can be sequentially performed.

The timing controller can individually control charging of first nodes of shift registers of lines to be sensed during an emission period using the first level shifter and the second level shifter.

The timing controller can provide, to the first level shifter and the second level shifter, reset signals for shifting voltages stored in the first nodes of the shift registers to second nodes during a non-emission period using the first level shifter and the second level shifter.

The first level shifter and the second level shifter can discharge the second nodes of the shift registers after sensing operation.

The first level shifter and the second level shifter can discharge the first nodes and second nodes of the shift registers after recovery operation.

In another aspect of the present invention, a method of driving a display device for external compensation includes dividing a display panel provided with a plurality of display lines into two display line areas to perform driving to output black data through a second display line area (B) while an image is displayed through a first display line area (A), outputting a signal for performing real-time (RT) sensing and recovery operation of display lines of a first area of the plurality of display lines in a non-emission period of one frame, and outputting a signal for performing real-time (RT) sensing and recovery operation of display lines of a second area of the plurality of display lines in the same non-emission period of the same frame, such that two display lines are sensed in the non-emission period of one frame.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Figure 1:
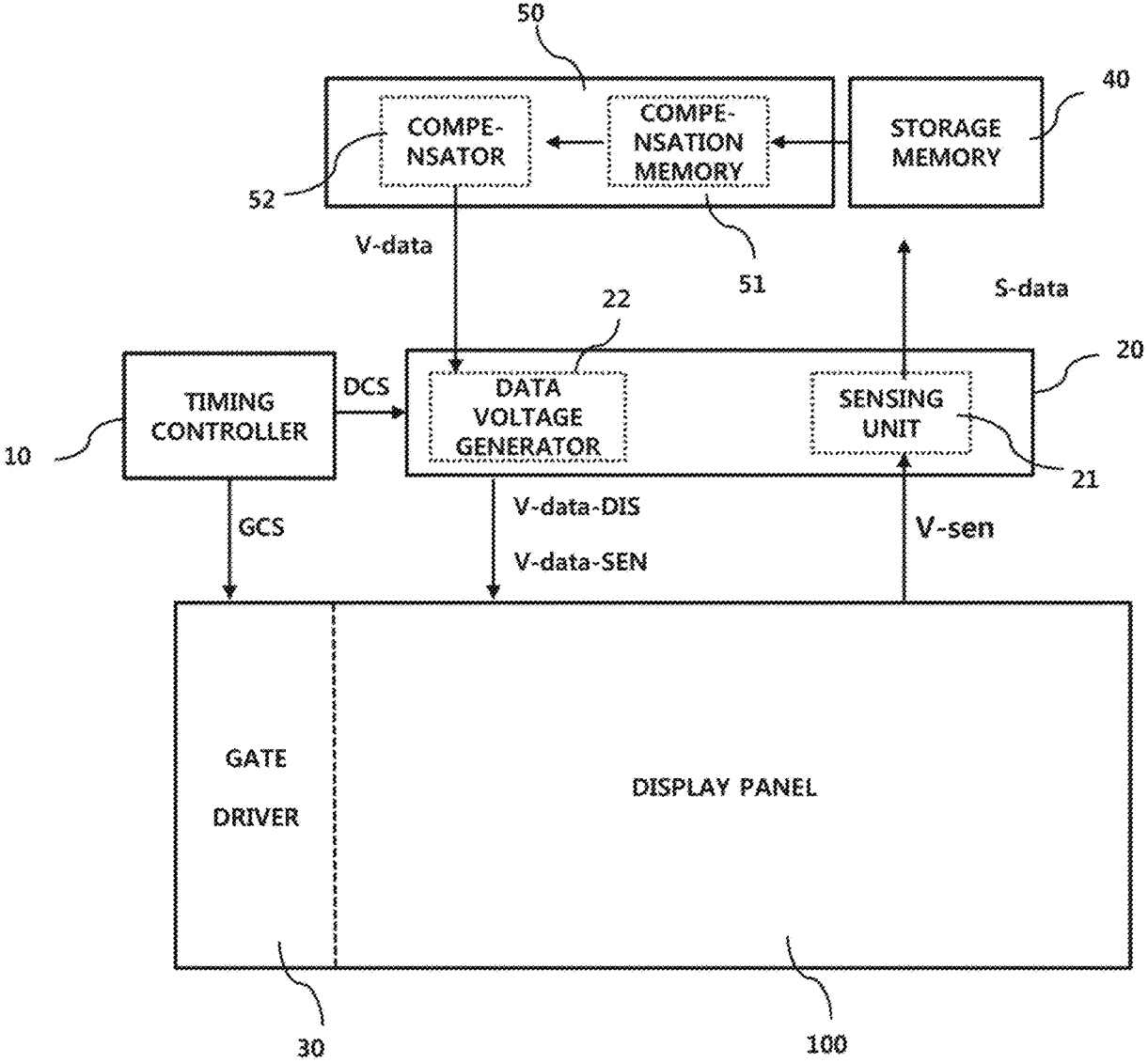
FIG. 1 is a block diagram showing an electroluminescent light emitting display device for external compensation according to an embodiment of the present invention.

Specific structures or functions are described for the purpose of explaining the embodiments of the present invention and the embodiments of the present invention can be implemented in a variety of forms and should not be limited to the embodiments disclosed herein.

Since the present invention can be variously modified and have several exemplary embodiments, specific exemplary embodiments will be shown in the accompanying drawings and described in detail. However, it is to be understood that the present invention is not limited to the specific exemplary embodiments, but includes all modifications, equivalents, and substitutions within the spirit and the scope of the present invention.

Terms such as 'first', 'second', etc., can be used to describe various components, but the components are not to be construed as being limited to the terms. The terms are used only to distinguish one component from another component. For example, the 'first' component can be named the 'second' component and the 'second' component can also be similarly named the 'first' component, without departing from the scope of the present invention.

It is to be understood that when one element is referred to as being "connected to" or "coupled to" another element, it can be connected directly to or coupled directly to another element or be connected to or coupled to another element, having the other element intervening therebetween. On the other hand, it is to be understood that when one element is referred to as being "connected directly to" or "coupled directly to" another element, it can be connected to or coupled to another element without the other element intervening therebetween. Other expressions describing a relationship between components, that is, "between," "directly between," "neighboring," "directly neighboring" and the like, should be similarly interpreted.

Terms used in the present specification are used only in order to describe specific exemplary embodiments rather than limiting the present invention. Singular forms used herein are intended to include plural forms unless explicitly indicated otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or combinations thereof.

Unless indicated otherwise, it is to be understood that all the terms used in the specification including technical and scientific terms have the same meaning as understood by those skilled in the art. It must be understood that the terms defined by the dictionary are identical with the meanings within the context of the related art, and they should not be ideally or excessively formally defined unless context clearly dictates otherwise.

On the other hand, if an embodiment is otherwise implemented, the functions or operations specified in particular blocks can be performed in an order different from the order specified in the flowchart. For example, two consecutive blocks can actually be performed substantially concurrently, and the blocks can be performed backwards depending on the associated function or operation.

Hereinafter, exemplary embodiments of the present invention will be described in detail with reference to the accompanying drawings. In the following embodiments, an organic light emitting display device including an organic light emitting material will be focused upon as a display device. However, the technical idea of the present invention is not limited to the organic light emitting display device and is applicable to an inorganic light emitting display device including an inorganic light emitting material. In addition, it should be noted that the technical idea of the present invention is applicable to various display devices such as flexible display devices, wearable display devices, etc. in addition to electroluminescent light emitting display devices.

Hereinafter, exemplary embodiments of the present invention will be described with reference to the accompanying drawings.

Figure 3:
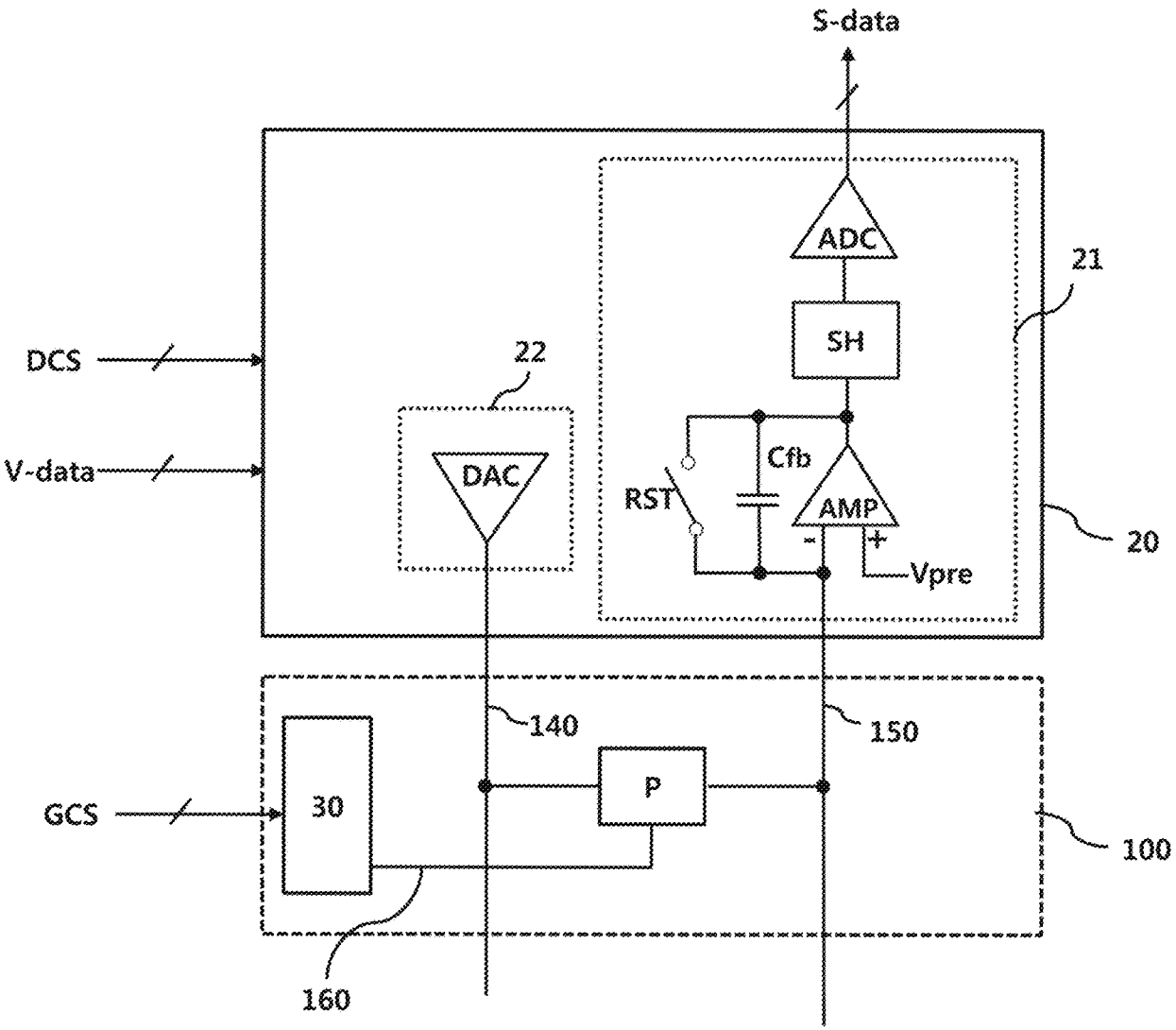

FIG. 1 is a block diagram showing an electroluminescent light emitting display device for external compensation according to an embodiment of the present invention, and FIGS. 1 and 3 are views showing connections between a real-time driving circuit for external compensation and a pixel according to an embodiment of the present invention. All components of the electroluminescent light emitting display device according to all embodiments of the present invention are operatively coupled and configured.

Figure 2:
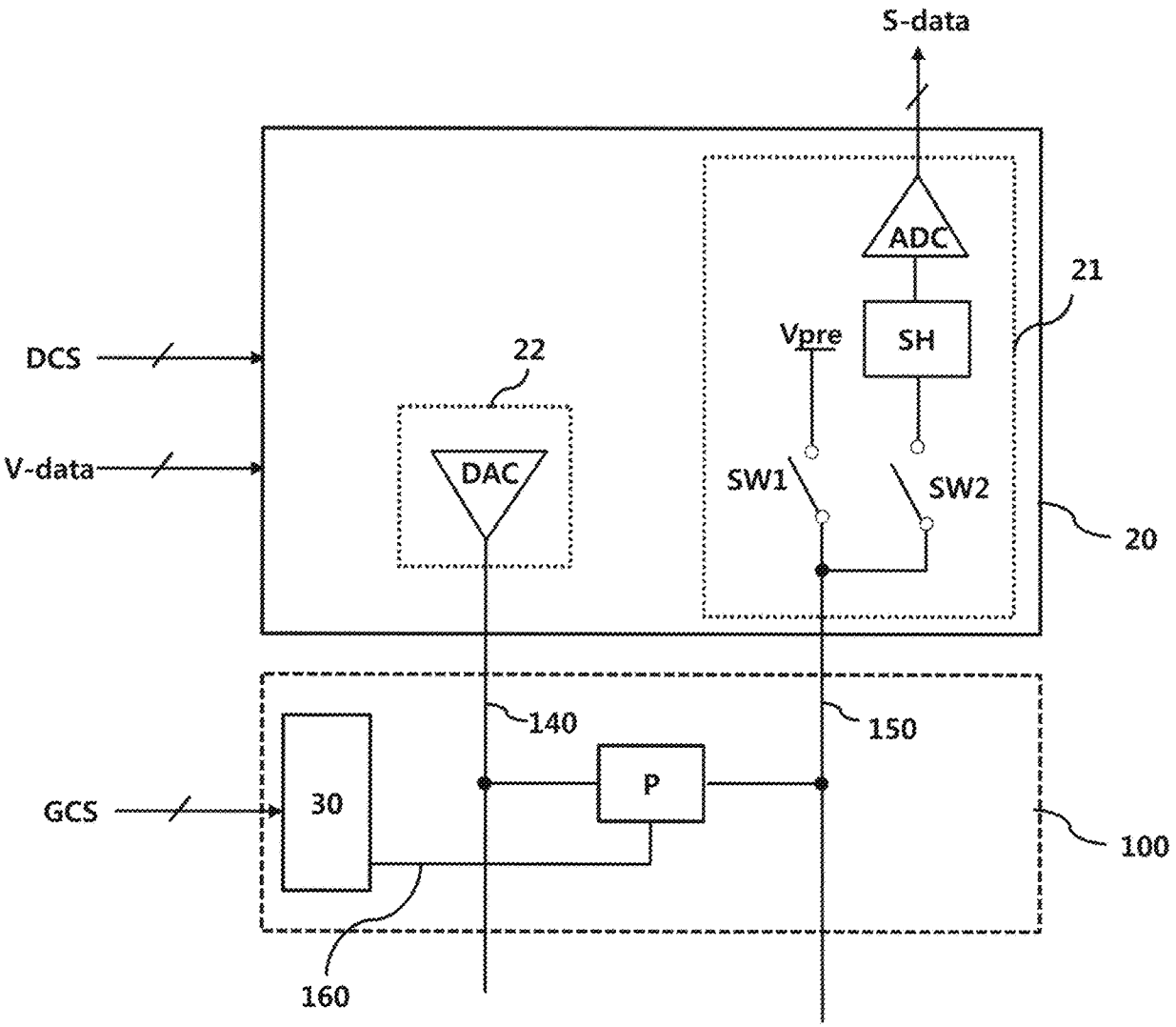
FIGS. 2 and 3 are views showing connections between a real-time driving circuit for external compensation and a pixel according to an embodiment of the present invention.

Referring to FIGS. 1 to 3, the electroluminescent light emitting device according to an embodiment of the present invention can include a display panel 100, a data driver 20, a gate driver 30, a storage memory 40 and a compensation circuit 500. The display panel 100 includes a plurality of pixels P and a plurality of signal lines. The signal lines can include data lines 140 for supplying an analog data voltage Vdata to the pixels P and gate lines 160 for supplying a gate signal to the pixels P. Here, the gate signal can include a first gate signal and a second gate signal. In this case, each of the gate lines 160 includes a first gate line for supplying the first gate signal and a second gate line for supplying the second gate signal. The signal lines can further include sensing lines 150 used to sense the electrical characteristics of the pixels P. However, the sensing lines 150 can be omitted according to the circuit configuration of the pixels P. In this case, the electrical characteristics of the pixels P can be sensed through the data lines 140.

The pixels P of the display panel 10 are arranged in a matrix to configure a pixel array. Each pixel P can be connected to at least any one of the data lines 140, any one of the sensing lines 150 and any one of the gate lines 160. Each pixel P is configured to receive high-potential pixel power and low-potential pixel power from a power generator. To this end, the power generator can supply the high-potential pixel power to the pixel through a high-potential pixel power wire or a pad. The power generator can supply the low-potential pixel power to the pixel through a low-potential pixel power wire or a pad.

The data driver 20 can include a sensing unit 21 and a data voltage generator 22, without being limited thereto.

The timing controller 10 can generate a gate timing control signal GCS for controlling operation timing of the gate driver 30 and a data timing control signal DCS for controlling operation timing of the data driver 20, by referring to timing signals received from an external device, such as a vertical synchronization signal Vsync, a horizontal synchronization signal Hsync, a dot clock signal DCLK and a data enable signal DE.

The data timing control signal DCS can include a source start pulse, a source sampling clock and a source output enable signal, without being limited thereto. The source start pulse controls data sampling start timing of the data voltage generator 220. The source sampling clock is a clock signal for controlling sampling timing of data based on a rising or falling edge. The source output enable signal controls output timing of the data voltage generator 22.

The gate timing control signal GCS can include a gate start pulse and a gate shift clock, without being limited thereto. The gate start pulse is applied to a stage for generating first output to activate operation of the stage. The gate shift clock is a clock signal commonly input to the stages to shift the gate start pulse.

The timing controller 10 controls sensing driving timing of one display line of the display panel 100 and display driving timing of the other display lines of the display panel 100 according to a predetermined sequence within the vertical active period of a specific frame, thereby implementing real-time sensing. Although described later, the "display line" described in connection with the embodiments of the present invention may not necessarily mean a physical signal line, but can preferably mean a pixel block line including neighboring pixels P.

Sensing driving and display driving are performed within the vertical active period of the specific frame. Here, the specific frame refers to a frame in which sensing is performed with respect to some display lines of the display panel 100 and display is performed with respect to the other display lines of the display panel 100. In the following description, the specific frame is referred to as a "sensing driving frame". In addition, some display lines with respect to which sensing is performed are referred to as "display lines to be sensed" and display lines with respect to which display is performed are referred to as "display lines to be displayed".

During the sensing driving frame, sensing of the display lines to be sensed is performed and an image of the other display lines to be displayed except for the display lines to be sensed is displayed on the display panel 100. In other words, during the sensing driving frame, display driving and sensing driving are simultaneously performed. One or a plurality of sensing driving frames can be included in a predetermined time according to frame frequency. Frames except for the sensing driving frame within the predetermined time are "normal driving frames". The normal driving frame means a frame in which display is only performed with respect to all display lines of the display panel 100. In other words, during the normal driving frame, sensing driving is not performed and only display driving is performed.

In sensing driving, the electrical characteristics of corresponding pixels P disposed on the display line(s) to be sensed are sensed in the sensing driving frames, the result of sensing, that is, analog sensing voltages Vsen are converted into digital sensing data, and a compensation value for compensating for the electrical characteristic change of the pixels P is updated based on the digital sensing data SDATA.

Display driving is driving for displaying an input image on sensed display lines, that is, the display lines to be displayed, and is performed in a sensing driving frame and a normal driving frame. Specifically, in display driving, the digital image data to be input to the pre-sensed pixels P is modulated based on an updated compensation value and the analog data voltage Vdata corresponding to the modulated digital image data V-DATA is applied to the corresponding pixels P, thereby displaying the input image at the sensed pixels P.

The timing controller 10 can differently generate timing control signals GCS and DCS for display driving and timing control signals GCS and DCS for sensing driving. Under control of the timing controller 10, sensing driving and display driving are performed within the vertical active period of the sensing driving frame. When sensing driving is performed in parallel to display driving within a vertical active period, time restriction is reduced as compared to the case where sensing driving is performed in parallel to display driving within a vertical blank period. In order to secure a sufficient sensing time within the vertical active period of the sensing driving frame, a time assigned to display needs to be reduced. To this end, the timing controller 10 can reduce the period of the gate timing signal of the sensing driving frame to be less than that of the gate timing signal of the normal driving frame.

The data voltage generator 22 includes a digital-to-analog converter (DAC) for converting a digital signal into an analog signal and generates and applies a display data voltage Vdata-DIS to the sensed pixels P of the display panel 100, for display driving. To this end, the data voltage generator 22 can convert the digital image data V-DATA modulated in the compensation circuit 50 into an analog gamma voltage and output the result of conversion to the data lines 140 as the display data voltage Vdata_DIS. In addition, the data voltage generator 22 generates and applies a sensing data voltage Vdata_SEN to the pixels P to be sensed of the display panel 100 through the data lines 140, for sensing driving.

The sensing unit 21 can sense the electrical characteristics of the pixels P to be sensed, for example, the electrical characteristics of the driving elements and/or the light emitting elements included in the pixels P to be sensed, for sensing driving. The sensing unit 21 can include a known voltage sensing unit or current sensing unit. The voltage sensing unit can sense the voltage stored in a specific node of the pixels P to be sensed as the analog sensing voltage Vsen according to a predetermined sensing condition. The current sensing unit can directly sense current flowing in a specific node of the pixels P to be sensed according to a predetermined sensing condition to obtain the analog sensing voltage Vsen.

The voltage sensing unit includes a sample and hold (SH) circuit and an analog-to-digital converter (ADC) as shown in FIG. 2 and senses the voltage of the source electrode of the driving element according to the pixel current of the driving element included in the pixels P to be sensed, that is, the voltage of the source electrode of the driving element stored in the line capacitor of the sensing line 150. The first and second switches SW1 and SW2 are selectively turned on. The first switch SW1 supplies an initial voltage Vpre to the sensing line 150 and the second switch SW2 is turned on in synchronization with sampling timing of the analog sensing voltage Vsen. The sample and hold (SH) circuit is connected to the sensing line 150 while the second switch SW2 is turned on to sample the voltage stored in the line capacitor of the sensing line 150 as the analog sensing voltage Vsen.

The ADC converts the analog sensing voltage Vsen sampled by the sample and hold (SH) circuit into digital sensing data SDATA.

The current sensing unit further includes a current integrator at a previous stage of the sample and hold (SH) circuit as shown in FIG. 3 and directly senses the pixel current of the driving element included in the pixels P to be sensed, which flows in the sensing line 150. The current integrator integrates the incoming pixel current through the sensing line 150 to generate the analog sensing voltage Vsen. The current integrator includes an amplifier AMP including an inverted input terminal (−) for receiving the pixel current of the driving element from the sensing line 150, a non-inverted input terminal (+) for receiving the initial voltage Vpre and an output terminal, an integral capacitor Cfb connected between the inverted input terminal (−) and the output terminal of the amplifier AMP, and a reset switch RST connected to both ends of the integral capacitor Cfb. The current integrator is connected to the ADC through the sample and hold (Sh) circuit. The sample and hold (SH) circuit samples the analog sensing voltage Vsen output from the amplifier AMP and supplies the sampled voltage to the ADC. The ADC converts the analog sensing value Vsen sampled by the sample and hold circuit SH into digital sensing data S-DATA.

The sensing unit 21 can simultaneously process the plurality of analog sensing values Vsen using a plurality of ADCs in parallel or sequentially process the plurality of sensing values using one ADC in series. There is a trade-off between the sampling speed of the ADC and sensing accuracy. The parallel processing ADC can delay the sampling rate to increase sensing accuracy as compared to the series-processing ADC. The ADC can be implemented as a flash type ADC, an ADC using a tracking scheme, a successive approximation register type ADC, etc. The ADC converts the analog sensing voltage Vsen into the digital sensing data S-DATA and supplies the digital sensing data to the storage memory 40, during sensing driving.

The storage memory 40 stores the digital sensing data S-DATA received from the sensing unit 21 during sensing driving. The storage memory 40 can be implemented as a flash memory, without being limited thereto.

The compensation circuit 30 calculates an offset and gain of each pixel based on the digital sensing data S-DATA read from the storage memory 40, modulates (or corrects) the digital image data to be input to the sensed pixels P according to the calculated offset and gain, and supplies the modulated digital image data V-DATA to the data driver 20, for display driving. To this end, the compensation circuit 50 can include a compensation memory 51 and a compensator 52.

The compensation memory 51 transmits the digital sensing data S-DATA read from the storage memory 40 to the compensator 52. The compensation memory 51 can be a random access memory such as a double data rate synchronous dynamic RAM (DDR SDRAM), without being limited thereto.

The compensator 52 can include a compensation algorithm for storing a predetermined average current (I)-voltage (V) curve through a plurality of sensing operations and performing compensation such that the I-V curve of a pixel to be compensated matches an average I-V curve.

Specifically, the compensator 52 derives Equation 2 below corresponding to the average I-V curve through a known least squares method after sensing of a plurality of gray scales.

$$I=a(V_{data}-b)^c \qquad \text{Equation 2}$$

In Equation 2, "a" denotes the electron mobility of the driving TFT, "b" denotes the threshold voltage of the driving TFT, and "c" denotes the physical characteristic value of the driving TFT.

The compensator 52 calculates values a' and b' which are the parameter values of the sensed pixel P based on the current values $I_1$ and $I_2$ measured at two points and gray scale values (X and Y gray scales) (that is, the data voltage values Vdata1 and Vdata2 of the digital levels). That is, the compensator 52 can calculate the values a' and b' which are the parameter values of the sensed pixel P using Equation 3 below and a quadratic equation.

$$I_1=a'V\text{data}_1-b')^c$$

$$I_2=a'V\text{data}_2-b')^c \qquad \text{Equation 3}$$

The compensator 52 can calculate an offset and gain for matching the I-V curve of the pixel to be compensated with the average I-V curve. The compensated offset and gain are shown in Equation 4 below. In Equation 4, "Vcomp" denotes a compensation voltage.

Equation 4

$$Vcomp = \underbrace{\boxed{\left(\frac{a}{a'}\right)^{1/c}}}_{\text{Gain}} X\,Vdata + \underbrace{\boxed{\left(b' - b\left(\frac{a}{a'}\right)^{1/c}\right)}}_{\text{Offset}}$$

The compensator 52 corrects the digital image data to be input to the sensed pixel P to correspond to the compensation voltage Vcomp.

In other words, the compensator 52 converts the digital image data to be input to the sensed pixel P into the data voltage value Vdata of the digital level, multiplies the data voltage value Vdata by gain, and adds the offset thereto, thereby generating the compensation voltage Vcomp of the digital level. In addition, the compensation voltage Vcomp of the digital level is converted into modulated digital image data V-DATA.

The gate driver 30 generates a display gate signal for display driving based on the gate timing control signal GCS and supplies the digital gate signal to the gate lines 160 connected to the display line to be displayed. The display gate signal is synchronized with the writing timing of the display data voltage Vdata-DIS. The gate driver 30 generates a sensing gate signal for sensing driving based on the gate timing control signal GCS and supplies the sensing gate signal to the gate lines 160 connected to the display line to be sensed. The sensing gate signal is synchronized with the writing timing of the sensing data voltage Vdata-SEN.

The gate driver 30 includes a gate shift register operating according to the gate timing control signal GCS received from the level shifter. The level shifter can be included in the timing controller 10, without being limited thereto. The level shifter receives the gate timing control signal GCS including a gate start pulse and N-phase (N being an integer equal to or greater than 2) gate shift clocks from the timing controller 10. The level shifter level-shifts the transistor-transistor-logic (TTL) level voltage of the gate timing control signal GCS to a gate high voltage and a gate low voltage capable of switching the TFT of the gate shift register. The level shifter supplies the level-shifted gate start pulse and N-phase gate shift clocks to the gate shift register.

The gate shift register includes a plurality of stages for shifting the gate start pulse according to the N-phase gate shift clocks within the vertical active period of each frame and outputting the display gate signal and/or the sensing gate signal. The stages are connected in cascade. Operation of a foremost stage of the stages is activated by the gate start pulse and operation of the remaining stages is activated according to an output signal (carry signal) of any one of the previous stages.

Figure 4:
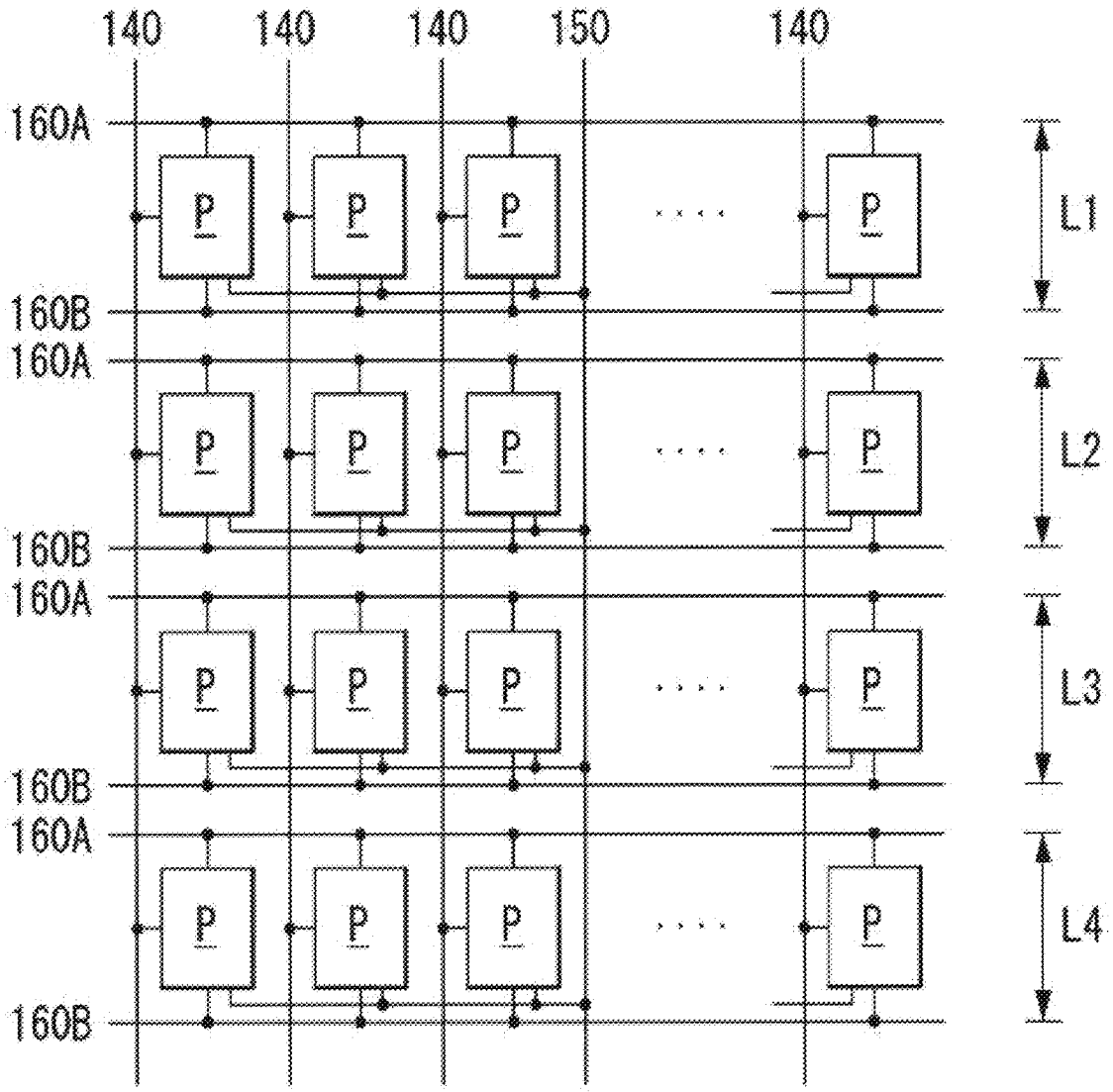
FIG. 4 is a view showing an example of a pixel array provided on a display panel according to the present invention.

FIG. 4 is a view showing an example of a pixel array provided on a display panel according to an embodiment of the present invention.

Referring to the example of FIG. 4, the pixel array of the present invention includes a plurality of display lines L1, L2, L3, L4, . . . composed of neighboring pixels P. Each of the display lines L1, L2, L3, L4, . . . is a physical signal line, but is a pixel block line composed of neighboring pixels P. The horizontally neighboring pixels P in each of the display lines L1, L2, L3, L4, . . . are connected to different data lines 140. In each of the display lines L1, L2, L3, L4, . . . , the horizontally neighboring pixels P are connected to different sensing lines 150 in units of M (M being a positive integer equal to or greater than 2), thereby increasing an aperture ratio of the display panel 10.

Referring to FIG. 4, in each display line, horizontally neighboring pixels P can be connected to the first gate line 160A and the second gate line 160B. In other words, two gate lines 160A and 160B can be assigned to each of the display lines L1, L2, L3, L4, . . . .

Figure 5:
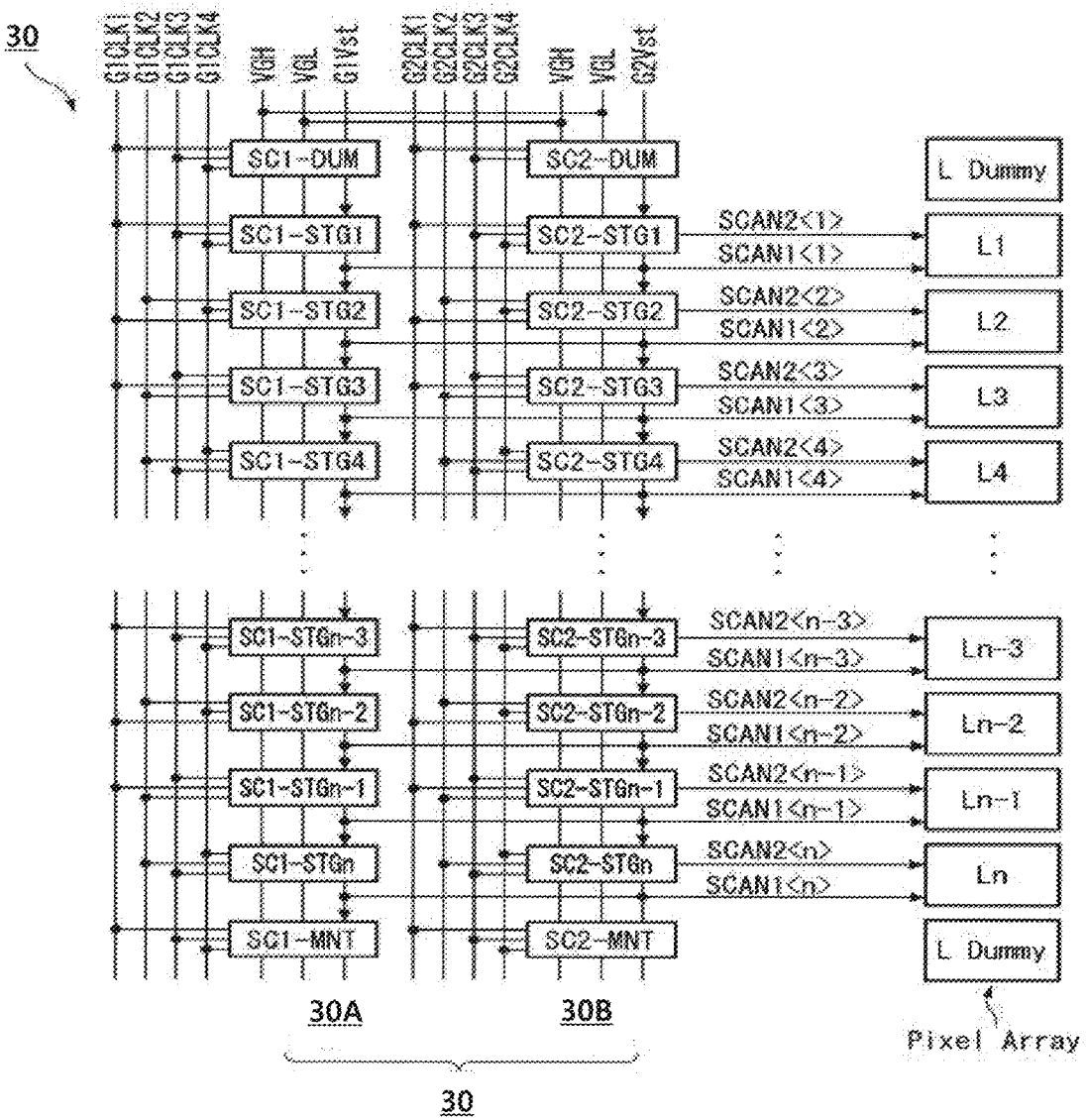
FIG. 5 is a view showing an example of the configuration of a gate driver for driving the pixel array of FIG. 4.

FIG. 5 is a view showing an example of the configuration of the gate driver 30 for driving the pixel array of FIG. 4.

Referring to FIG. 5, the gate driver 30 according to the embodiment of the present invention includes a first gate driver 30A for generating a first gate signal SCAN1 to be supplied to the first gate lines 160A and a second gate driver 30B for generating a second gate signal SCAN2 to be supplied to the second gate lines 160B.

The gate shift register is formed on the display panel in the non-display area (that is, a bezel area) outside the pixel array and can be formed by the same TFT process as the pixel array. Specifically, the gate driver 30 includes the first gate driver 30A having stages SC1-STG1 to SC1-STGn corresponding to the display lines L1 to Ln of the pixel array and the second gate driver 30B having stages SC2-STG1 to SC1-STGn corresponding to the display lines L1 to Ln of the pixel array.

In FIG. 5, SC1-DUM, SC2-DUM, SC1-MNT and SC2-MNT mean dummy stages. L Dummy denotes a dummy display line. In addition, VGH and VGL applied to the stages mean driving voltages, wherein VGH denotes a gate high voltage and VGL denotes a gate low voltage. The dummy stage and the dummy display line can be selectively included or excluded. Since the kick back of the display line adjacent to the dummy display line is reduced by the dummy stage and the dummy display line, the charging signal of the adjacent display line can be stabilized. The pixel of the dummy display line is similar to the pixel P of the display line, and is configured not to emit light. That is, the dummy display line can be configured not to include at least an OLED or not to receive a data voltage or a gate signal.

The first gate driver 30A generates and sequentially supplies the first display gate signal SCANT to the first gate lines 160A located at the display line to be displayed, that is, the first gate lines 160A connected to the pixels to be displayed. In addition, the first gate driver 30A generates and supplies the first sensing gate signal SCAN1 to the first gate line 160A located at at least one display line to be sensed, that is, the first gate line 160A connected to the pixels to be sensed.

Each of the stages SC1-STG1 to SC1-STGn configuring the first gate driver 30A can be individually connected to one display line. The stages SC1-STG1 to SC1-STGn of the first gate driver 30A sequentially shift the first gate start pulse G1Vst according to the first gate shift clock groups G1CLK1 to G1CLK4 and generate the first display gate signal SCAN1<1> and the first sensing gate signal SCAN1.

The second gate driver 30B generates and sequentially supplies the second display gate signal SCAN2 to the second gate lines 160B located at the display line to be displayed, that is, the second gate lines 160B connected to the pixels to be displayed. In addition, the second gate driver 30B generates and supplies the second sensing gate signal SCAN2 to the second gate line 160B located at at least one display line to be sensed, that is, the second gate line 160B connected to the pixels to be sensed.

Each of the stages SC2-STG1 to SC2-STGn configuring the second gate driver 30B can be individually connected to one display line. The stages SC2-STG1 to SC2-STGn of the second gate driver 30B sequentially shift the second gate start pulse G2Vst according to the second gate shift clock groups G2CLK1 to G2CLK4 and generate the second display gate signal SCAN2 and the second sensing gate signal SCAN2.

Figure 6:
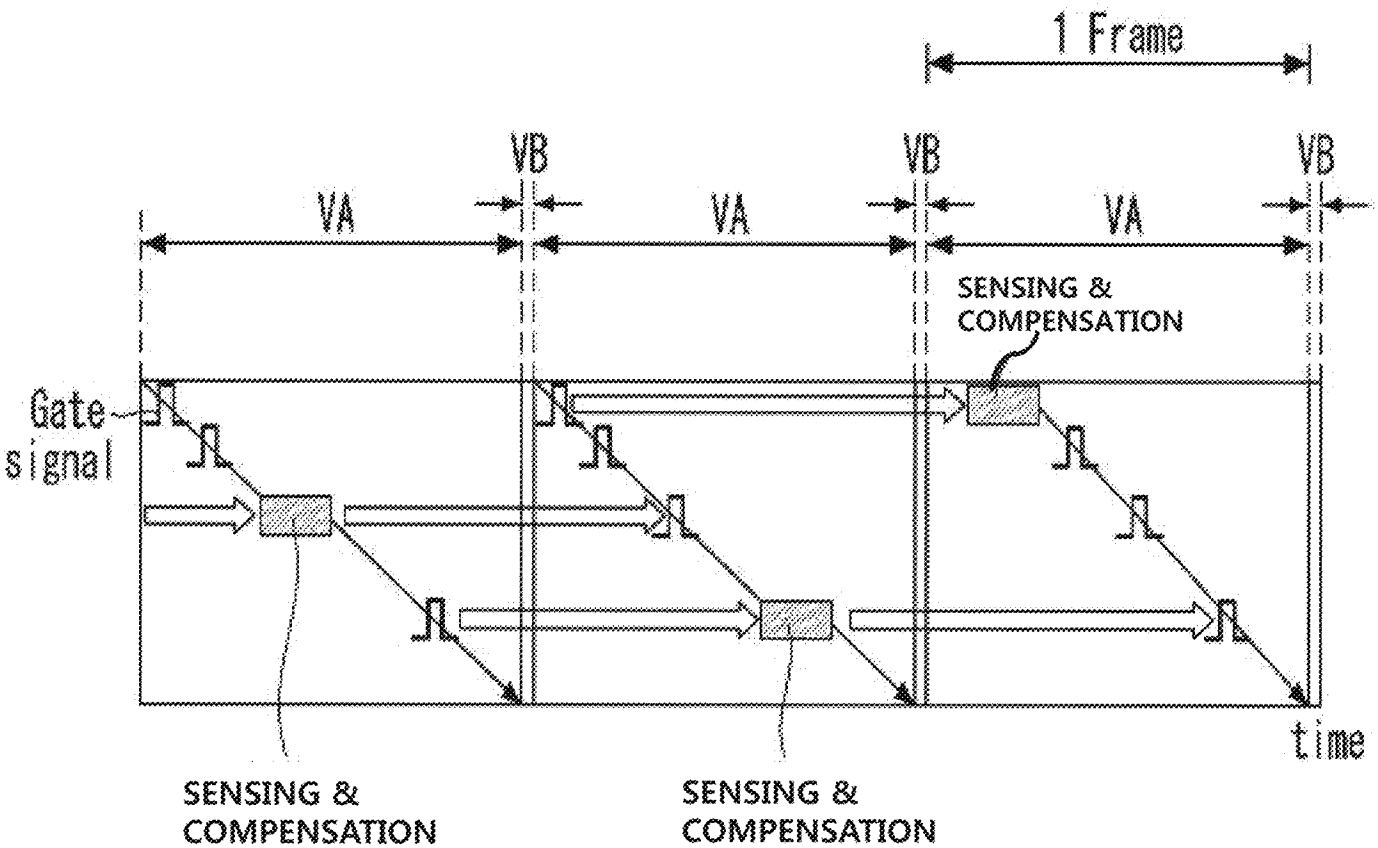
FIGS. 6 and 7 are schematic views showing real-time external compensation technology of an embodiment of the present invention for performing real-time sensing within a vertical active period of a sensing driving frame.
Figure 7:
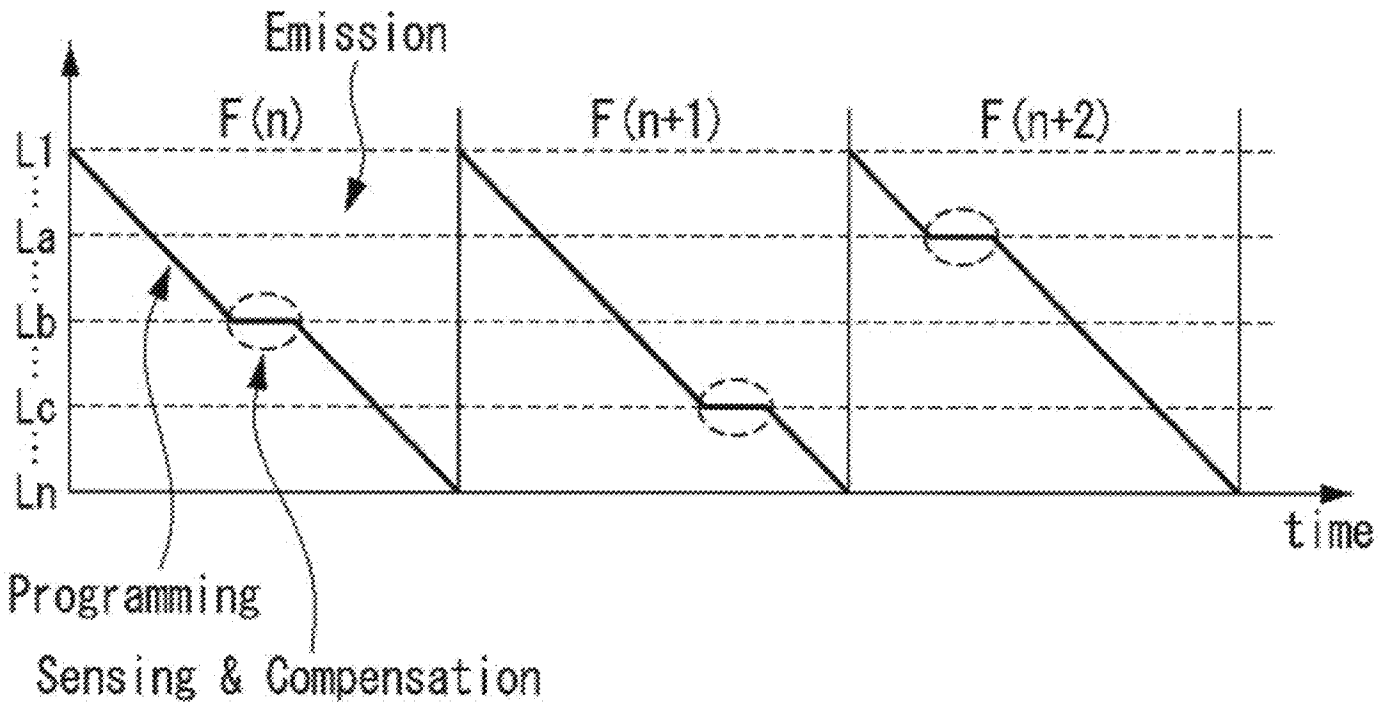

FIGS. 6 and 7 are schematic views showing real-time external compensation technology of an embodiment of the present invention for performing real-time sensing within a vertical active period of a sensing driving frame.

In one or more embodiments of the present invention, when the electrical characteristics of the pixels P is sensed according to a real-time external compensation method, sensing driving is not performed as in the related art, but sensing driving is performed along with display driving within the vertical active period VA of the sensing driving frame as shown in FIG. 6. The digital sensing data S-DATA is obtained through sensing driving and the compensation value is obtained based thereon.

In one or more embodiments of the present invention, at least one display line is sensed in each vertical active period VA of the sensing driving frame. When a plurality of display lines is sensed in one vertical active period VA, the plurality of display lines can be sequentially sensed.

The pixels disposed on the display line to be sensed do not emit light. Accordingly, in order to minimize the display line to be sensed which is visible as a line dim, the positions of the display lines to be sensed in each sensing driving frame are non-sequentially (or randomly) predetermined. For example, as shown in FIG. 7, the positions of the display lines to be sensed can be set to a b-th display line Lb of an n-th frame Fn, a c-th display line of an (n+1)-th frame Fn+1, and an a-th display line La of an (n+2)-th frame Fn+2. Here, Lc is spatially separated from Lb by several to several hundred display lines and is disposed below Lb, without being limited thereto. In addition, La is spatially separated from Lc by several to several hundred display lines and is disposed above Lc, without being limited thereto. The human eye more sensitively responds to sequential change as compared to non-sequential change. Accordingly, when the positions of the display lines to be sensed in each sensing driving frame are randomly set, it is possible to prevent the display lines to be sensed from being viewed as line dims.

Figure 8:
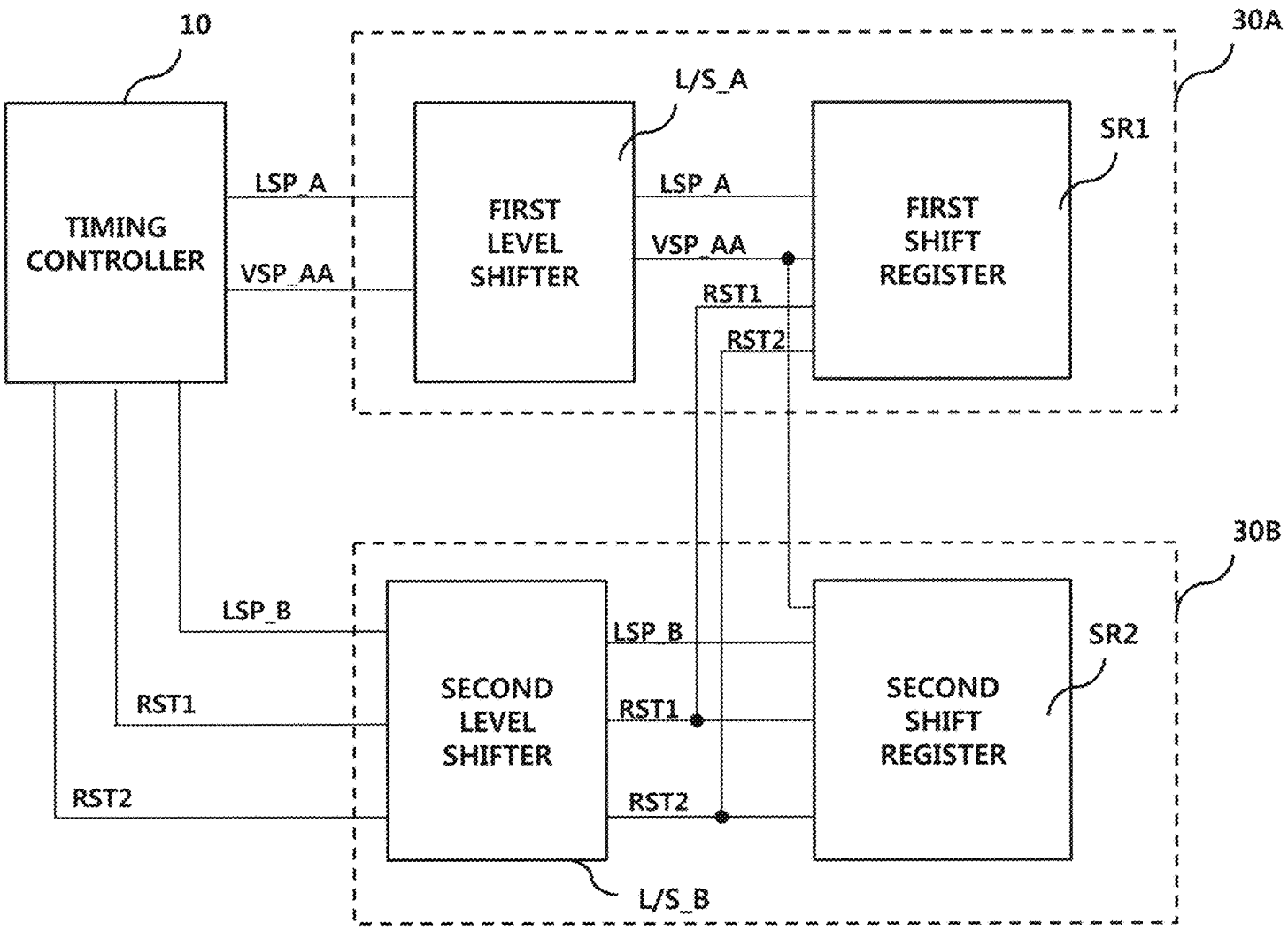
FIG. 8 is a view showing the configuration of a display device for external compensation according to an embodiment of the present invention.

In one or more embodiments of the present invention, assume that the gate shift register is directly formed on the lower substrate of the display panel 100 using a gate in panel (GIP) method. As shown in FIG. 8, the first gate driver 30A according to the present invention can include a first level shifter L/S_A and the second gate driver 30B can include a second level shifter L/S_B.

The timing controller 10 provides a signal "LSP_A" for charging the first node node1 of the first shift register SR1 to the first level shifter L/S_A of the first gate driver 30A in the active period. At this time, a signal "LSP_B" for charging the first node node1 of the second shift register SR2 is provided to the second level shifter L/S_B of the second gate driver 30B. The first nodes node1 of the shift registers of two display lines are charged using signals distinguishably input to the first and second level shifters L/S_A and L/S_B.

The timing controller 10 transmits a signal "VSP_AA" for temporarily discharging the second nodes node2 of the first and second shift registers SR1 and SR2 to the first and second level shifters L/S_A and L/S_B at the time of on/off.

In addition, the timing controller 10 supplies, to the second level shifter L/S_B, a first reset signal RST1 which is a signal for supplying the voltage stored in the first node node1 of each of the first and second shift registers SR1 and SR2 to the second nodes node2 of each shift register and a second reset signal RST2 for discharging the voltage stored in the second node node2 of each shift register.

The first node node1 of the first shift register SR1 is charged during the active period by "LSP_A" received from the first level shifter L/S_A. The voltage stored in the first node node1 of the first shift register SR1 is supplied to the second node node2 by the first reset signal RST1. The voltage stored in the second node node2 of the first shift register SR1 is completely discharged by the second reset signal RST2.

The first node node1 of the second shift register SR2 is charged during the active period by "LSP_B" received from the second level shifter L/S_B. The voltage stored in the first node node1 of the second shift register SR2 is supplied to the second node node2 by the first reset signal RST1. The voltage stored in the second node node2 of the second shift register SR2 is completely discharged by the second reset signal RST2.

Figure 9:
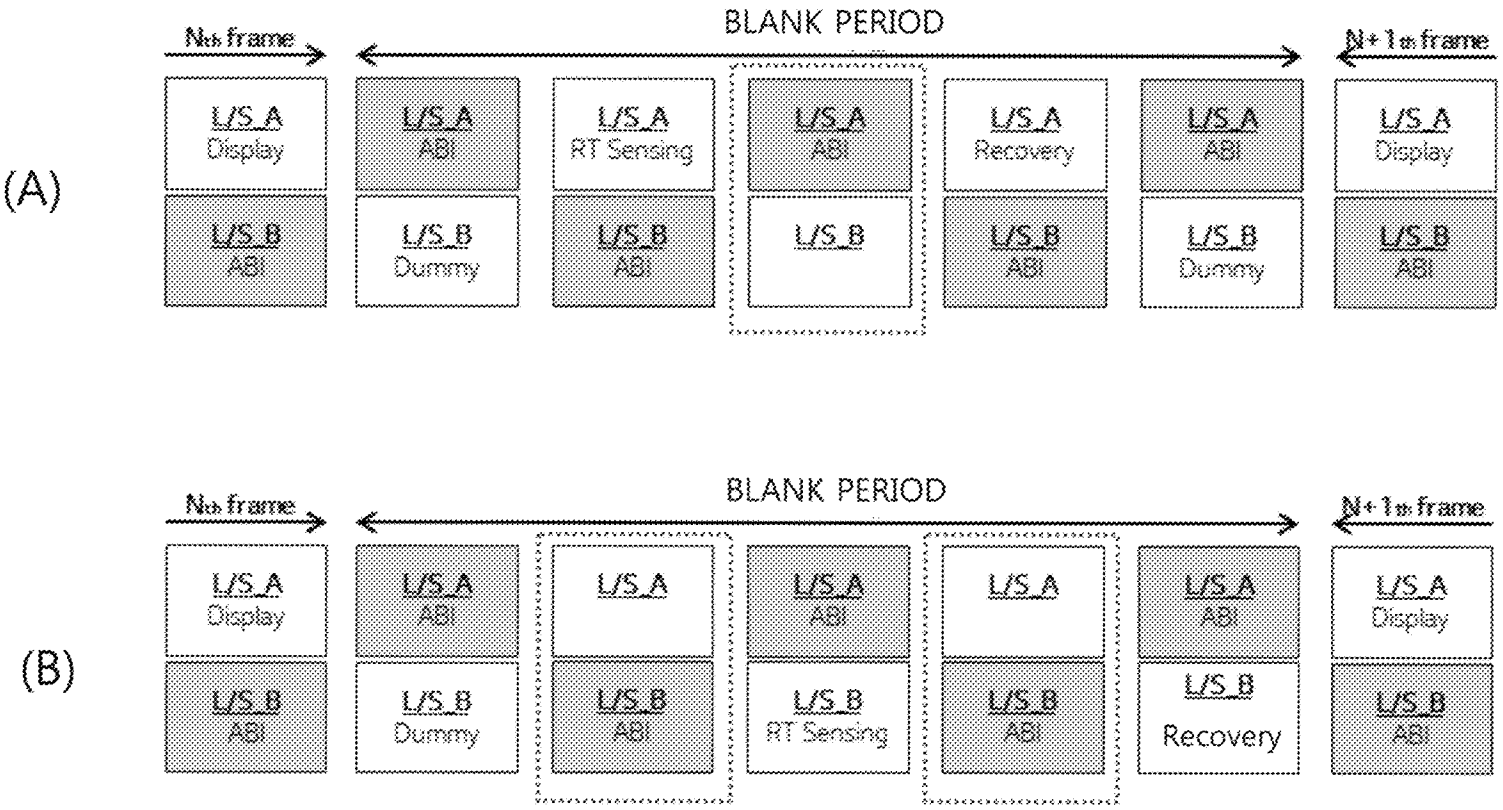
FIG. 9 is a view showing operation of a first level shifter L/S_A and a second level shifter L/S_B during a vertical blanking period in the display device having the configuration of FIG. 8.

FIG. 9 is a view showing sensing of a plurality of display lines in a vertical active period VA and operation of a first level shifter L/S_A and a second level shifter L/S_B during a vertical blanking period VA. (A) shows real-time sensing operation in the first level shifter L/S_A and the second level shifter L/S_B when the first node of the first shift register SR1 is charged and (B) shows real-time sensing operation in the first level shifter L/S_A and the second level shifter L/S_B when the first node of the second shift register SR2 is charged.

In the case of (A), the first level shifter L/S_A outputs black data and the second level shifter L/S_B serves as a dummy. Meanwhile, while real-time (RT) sensing is performed in the first level shifter L/S_A, the second level shifter L/S_B outputs black data. Thereafter, the first level shifter L/S_A outputs black data again and the second level shifter L/S_B does not perform separate operation. After real-time sensing is performed using the first level shifter L/S_A, while the first level shifter L/S_A provides a recovery signal Recovery, the second level shifter L/S_B outputs black data. That is, after the sensing step, a recovery signal output time including a recovery initiation step and a recovery step can be necessary to prevent subpixel rows (lines) which have been subjected to mobility sensing from being viewed on the screen at the time of next image driving. In the recovery initiation step, a data voltage corresponding to the black data BLK is applied to the driving transistor DRT through the data line DL. In the recovery step, a data voltage corresponding to recovery data is applied to the driving transistor DRT through the data line DL.

While the first level shifter L/S_A outputs black data again, the second level shifter L/S_B serves as a dummy.

In the case of (B), while the second level shifter L/S_B outputs black data, the first level shifter L/S_A does not perform separate operation. While the second level shifter L/S_B performs real-time (RT) sensing, the first level shifter L/S_A outputs black data. While the second level shifter L/S_B outputs black data again, there is a time when the first level shifter L/S_A does not perform separate operation. After RT sensing is performed using the second level shifter L/S_B, while the second level shifter L/S_B provides a recovery signal Recovery, the first level shifter L/S_A outputs black data.

As shown in the figure, in the cases of (A) and (B), an idle period (dotted display period) in which, while one level shifter outputs black data, the other level shifter does not perform operation is present.

Figure 10:
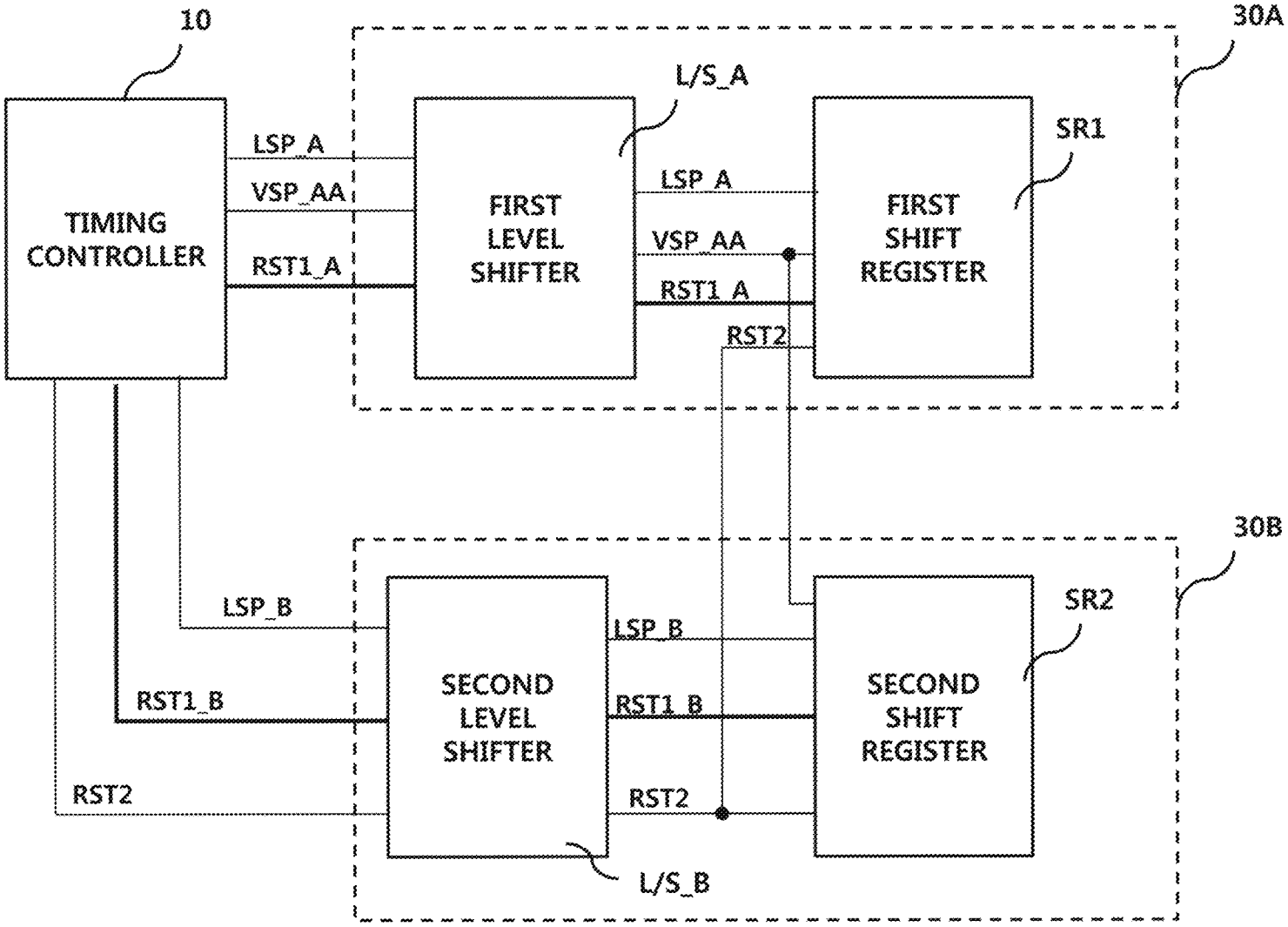
FIG. 10 is a view showing the configuration of a display device for external compensation according to another embodiment of the present invention.

In order to efficiently use such an idle period, as in another embodiment of the present invention shown in FIG. 10, the timing controller 10 can supply first reset signals RST1_A and RST1_B to the first level shifter L/S_A and the second level shifter L/S_B, respectively. Unlike the configuration of FIG. 8, the timing controller 10 can divide the plurality of display lines into two areas, perform driving such that black data is output through the second display line area B while an image is displayed through the first display line area A, and output a signal for performing control such that two display lines are sensed in one non-emission period. At this time, the second level shifter L/S_B does not supply the first reset signal RST to the first shift register SR1. Therefore, the first level shifter L/S_A receives a control signal from the timing controller and outputs a signal for driving RT sensing and recovery of the first display line area of the plurality of display lines in the non-emission period of one frame, and the second level shifter L/S_B receives a control signal from the timing controller and outputs a signal for driving RT sensing and recovery of the second display line area of the plurality of display lines in the same non-emission period of the same frame.

Figure 11:
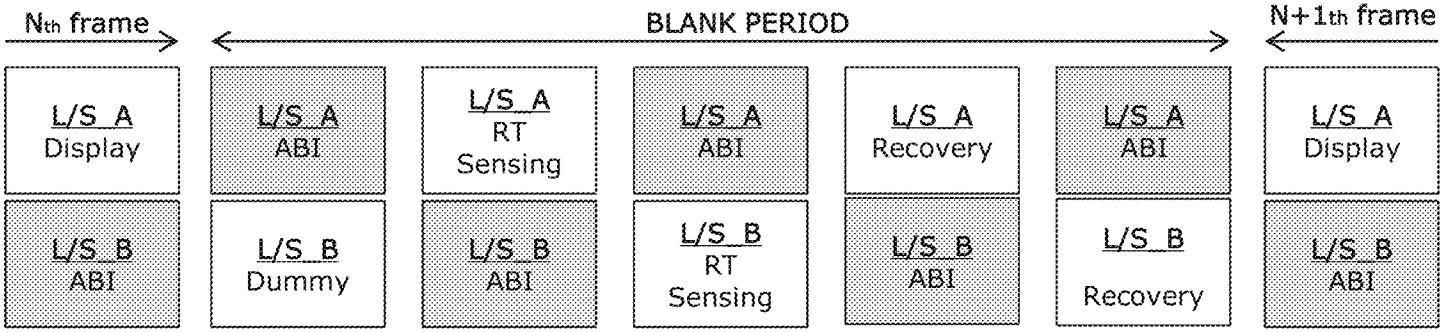
FIG. 11 is a view showing operation of a first level shifter L/S_A and a second level shifter L/S_B during a vertical blanking period in the display device having the configuration of FIG. 10.

As shown in FIG. 11, the first level shifter L/S_A and the second level shifter L/S_B alternately perform RT sensing and recovery operation during the non-emission period of one frame.

First, while the first level shifter L/S_A outputs black data, the second level shifter L/S_B serves as a dummy.

Figure 12A:
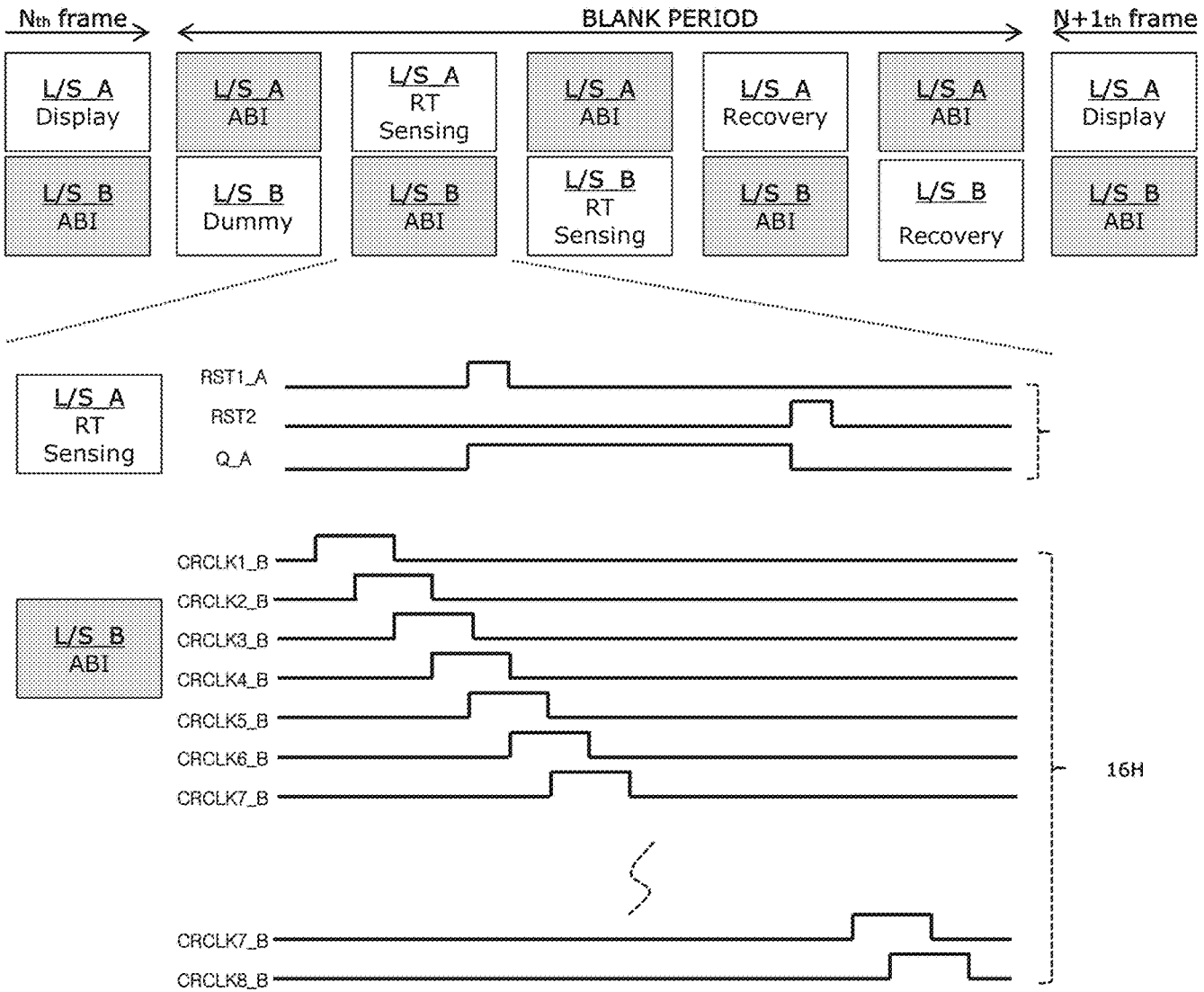
FIGS. 12A to 12D are views showing examples of the output waveforms of a first level shifter L/S_A and a second level shifter L/S_B according to an embodiment of the present invention.

While the first level shifter L/S_A outputs a signal for performing RT sensing, the second level shifter L/S_B outputs black data. As shown in FIG. 12A, when the second level shifter L/S_B outputs black data, the first level shifter L/S_A shifts the voltage stored in the first node node1 of the first shift register SR1 to the second node node2 (denoted by Q_A) using the first reset signal RST1_A and discharges the voltage of the second node node2 of the first shift register SR2 using the second reset signal RST2 after sensing. Although compensation is repeatedly performed in units of 16 data lines in the present embodiment, the present invention is not limited thereto.

Figure 12B:
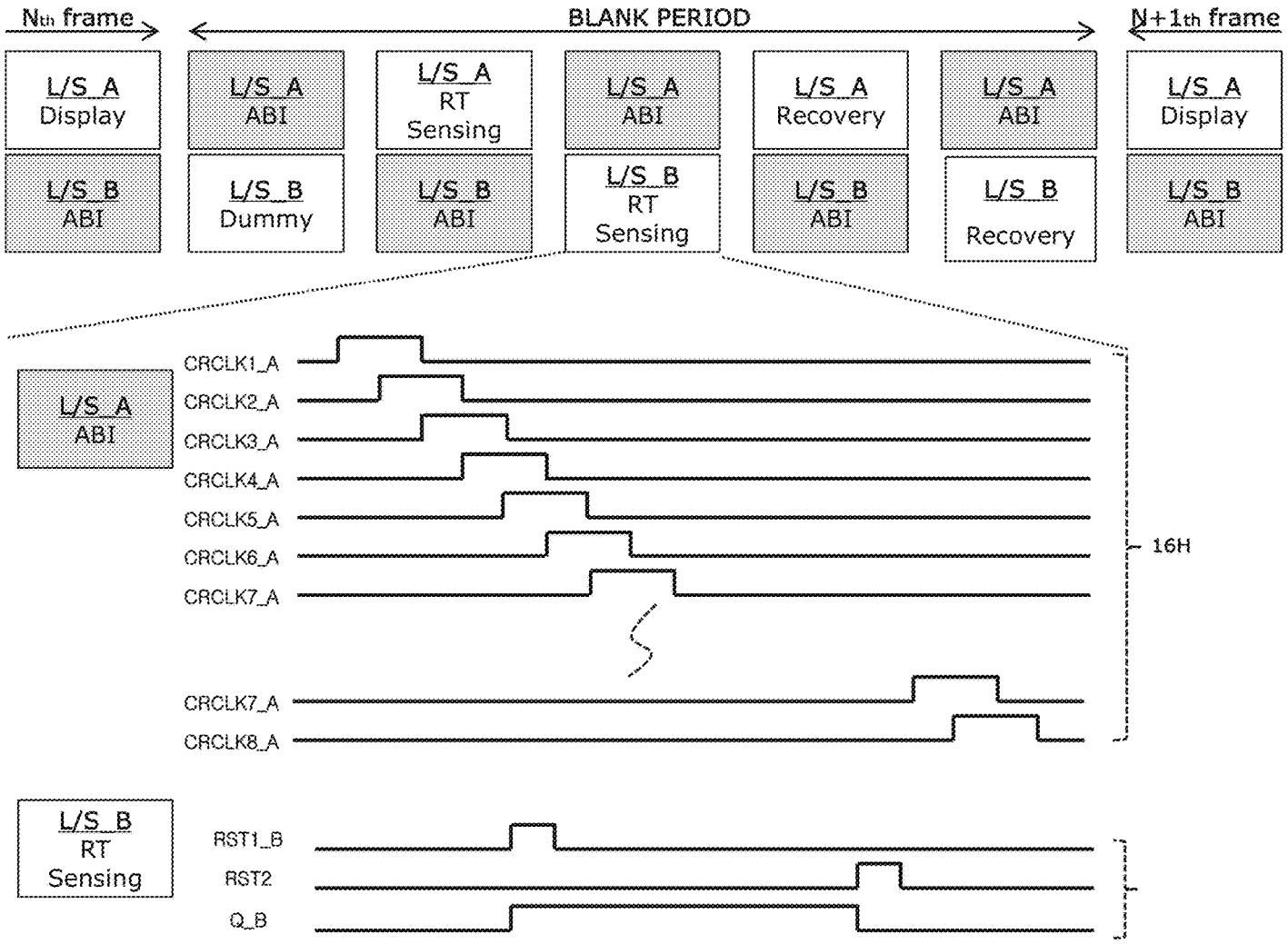

Thereafter, the first level shifter L/S_A outputs black data and the second level shifter L/S_B outputs a signal for performing RT sensing. As shown in FIG. 12B, when the first level shifter L/S_A outputs black data, the second level shifter L/S_B shifts the voltage stored in the first node node1 of the second shift register SR2 to the second node node2 (denoted by Q_B) using the first reset signal RST1_B and discharges the voltage of the second node node2 of the second shift register SR2 using the second reset signal RST2 after sensing.

Figure 12C:
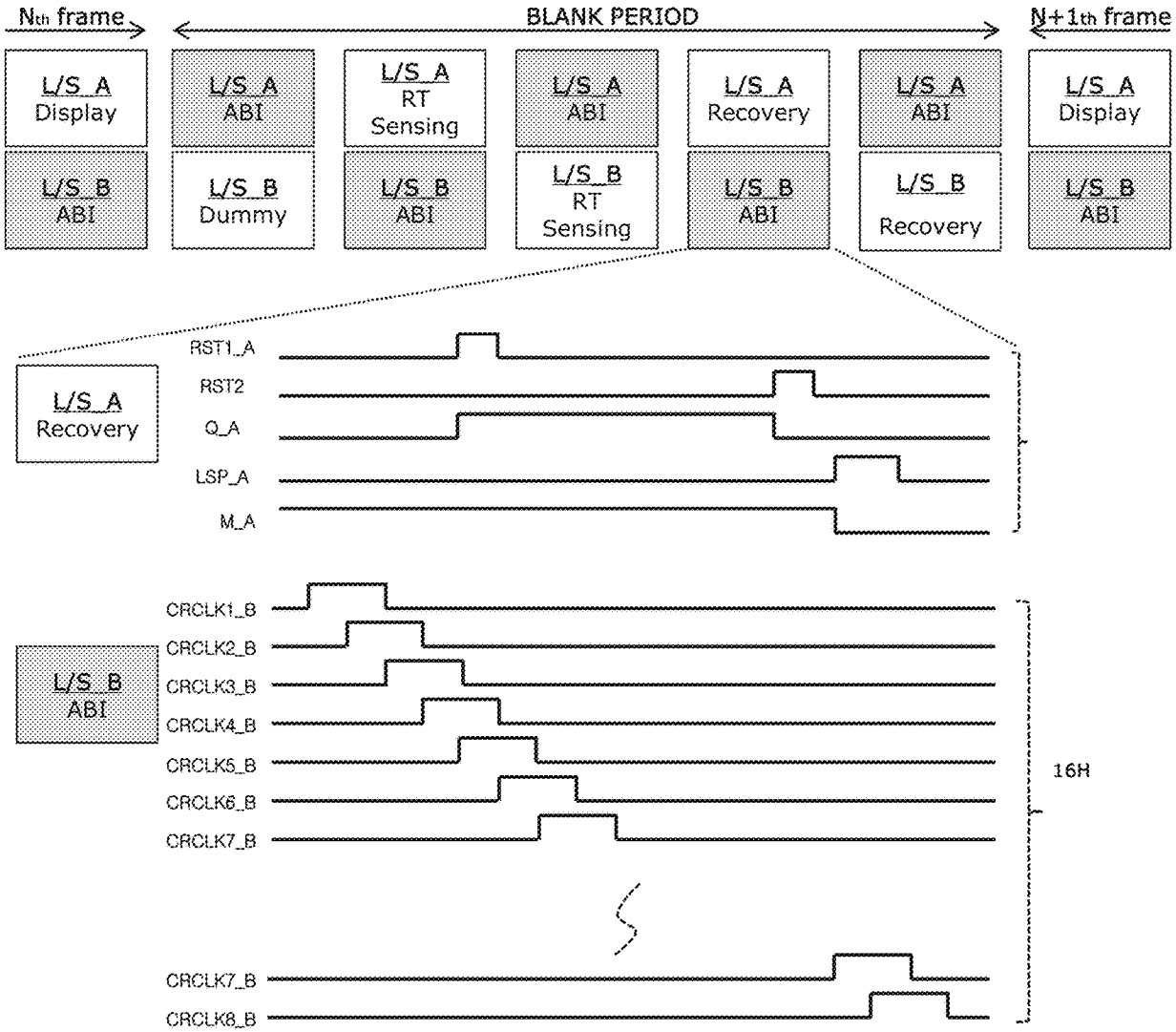

Subsequently, while the first level shifter L/S_A provides the recovery signal Recovery to the first shift register SR1, which has performed RT sensing, the second level shifter L/S_B outputs black data. As shown in FIG. 12C, the first level shifter L/S_A performs recovery operation (denoted by M_A and Q_A) after the first reset signal RST1_A is provided to the first shift register SR1 to shift the voltage of the first node of the first shift register SR1 to the second node, discharges the voltage of the second node node2 of the first shift register SR1, and discharges the voltage stored in the first node of the first shift register SR1 using the signal "LSP_A" (denoted by LSP_A and M_A).

Figure 12D:
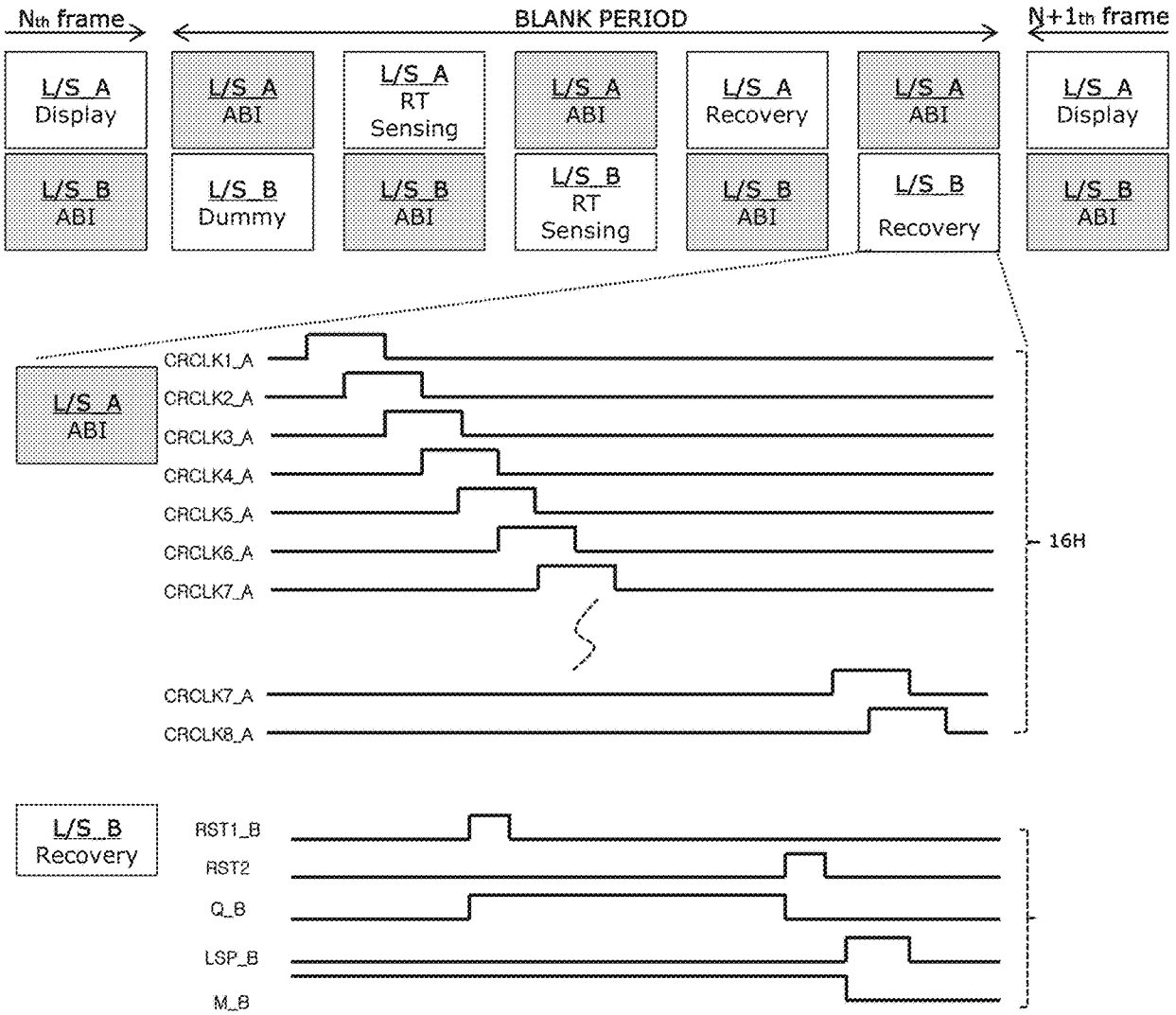

While the first level shifter L/S_A outputs black data, the second level shifter L/S_B outputs the recovery signal Recovery to the second shift register SR2, which has performed RT sensing. As shown in FIG. 12D, while the first level shifter L/S_A outputs black data using CRCLK1_A to CRCLK8_A and shifted CRCLK1_A to CRCLK8_A, the second level shifter L/S_B performs recovery operation (denoted by M_B and Q_B) after the first reset signal RST1_B is provided to the second shift register SR2 to shift the voltage of the first node of the second shift register SR2 to the second node, discharges the voltage of the second node of the second shift register SR2, and discharges the voltage stored in the first node of the second shift register SR2 using the signal "LSP_B" (denoted by LSP_B and M_B).

As described above, in the display device for external compensation according to the embodiment of the present invention, the timing controller outputs a signal for performing control to sense two display lines in the non-emission period of one frame, thereby updating and displaying a compensated screen to a user at double speed. If three level shifters are used, a threefold compensation speed can be theoretically possible.

The display device for external compensation and the method of driving the same according to one or more embodiments of the present invention have at least the following effects and advantages.

First, it is possible to shorten a real-time compensation time.

Second, it is possible to compensate for two display lines in real time during one frame.

Third, it is possible to efficiently utilize two level shifters.

Although the invention has been described with reference to the exemplary embodiments, those skilled in the art will appreciate that various modifications and variations can be made in the present invention without departing from the spirit and scope of the invention described in the appended claims.

What is claimed is:

1. A display device for external compensation, the display device comprising:

a display panel including a plurality of display lines each including a plurality of pixels;

a timing controller configured to divide the plurality of display lines into two areas, to output black data through a second display line area while an image is displayed through a first display line area, and to output a signal for performing control to sense two display lines in a non-emission period of one frame;

a first level shifter configured to receive a control signal from the timing controller and to output a signal for performing a real-time (RT) sensing and recovery operation of the first display line area of the plurality of display lines in one non-emission period; and a second level shifter configured to receive a control signal from the timing controller and to output a signal for performing an RT sensing and recovery operation of the second display line area of the plurality of display lines in one non-emission period.

2. The display device for external compensation according to claim 1, wherein the first level shifter and the second level shifter alternately perform the RT sensing and recovery operations during one non-emission period.

3. The display device for external compensation according to claim 2, wherein the second level shifter outputs black data while the first level shifter performs the RT sensing operation and recovery operation, and the first level shifter outputs black data while the second level shifter performs the RT sensing operation and recovery operation.

4. The display device for external compensation according to claim 3, wherein:

operation of outputting black data by the second level shifter when the first level shifter performs RT sensing operation, operation of performing RT sensing operation by the second level shifter while the first level shifter outputs black data, operation of outputting black data by the second level shifter when the first level shifter performs recovery operation, and operation of performing recovery operation by the second level shifter while the first level shifter outputs black data, are sequentially performed.

5. The display device for external compensation according to claim 1, wherein the timing controller individually controls charging of first nodes of shift registers of lines to be sensed during an emission period using the first level shifter and the second level shifter.

6. The display device for external compensation according to claim 5, wherein the timing controller provides, to the first level shifter and the second level shifter, reset signals for shifting voltages stored in the first nodes of the shift registers to second nodes during a non-emission period using the first level shifter and the second level shifter.

7. The display device for external compensation according to claim 6, wherein the first level shifter and the second level shifter discharge the second nodes of the shift registers after sensing operation.

8. The display device for external compensation according to claim 7, wherein the first level shifter and the second level shifter discharge the first nodes and second nodes of the shift registers after recovery operation.

9. A method of driving a display device for external compensation, the method comprising:

dividing a display panel provided with a plurality of display lines into two display line areas to perform driving to output black data through a second display line area while an image is displayed through a first display line area;

outputting a signal for performing a real-time (RT) sensing and recovery operation of display lines of a first area of the plurality of display lines in a non-emission period of one frame; and outputting a signal for performing an RT sensing and recovery operation of display lines of a second area of the plurality of display lines in the same non-emission period of the same frame, so that two display lines are sensed in the non-emission period of one frame.

10. The method according to claim 9, wherein the RT sensing and recovery operation of the display lines of the first area and the RT sensing and recovery operation of the display lines of the second area are alternately performed.

11. The method according to claim 10, wherein black data is output to the display lines of the second area while the RT sensing and recovery operation of the display lines of the first area is performed, and black data is output to the display lines of the first area while the RT sensing and recovery operation of the display lines of the second area is performed.

12. The method according to claim 10, wherein the alternately performing the RT sensing and recovery operation of the display lines of the first area and the second area includes sequentially performing operations of:

outputting black data to the display lines of the second area when RT sensing is performed with respect to the display lines of the first area;

performing RT sensing operation with respect to the display lines of the second area while black data is output to the display lines of the first area;

outputting black data to the display lines of the second area when recovery operation is performed with respect to the display lines of the first area; and performing recovery operation with respect to the display lines of the second area while black data is output to the display lines of the first area.

* * * * *